US008349033B2

(12) United States Patent
Muth

(10) Patent No.: US 8,349,033 B2
(45) Date of Patent: Jan. 8, 2013

(54) DIESEL FUEL, DIESEL FUEL ADDITIVE, AND ASSOCIATED METHOD FOR USING THE SAME

(75) Inventor: Steven A. Muth, Brookfield, IL (US)

(73) Assignee: The Penray Companies, Inc., Wheeling, IL (US)

( * ) Notice: Subject to any disclaimer, the term of this patent is extended or adjusted under 35 U.S.C. 154(b) by 439 days.

(21) Appl. No.: 12/131,191

(22) Filed: Jun. 2, 2008

(65) Prior Publication Data

US 2008/0295397 A1 Dec. 4, 2008

Related U.S. Application Data

(60) Provisional application No. 60/940,986, filed on May 31, 2007.

(51) Int. Cl.
*C10L 1/19* (2006.01)

(52) U.S. Cl. ..... 44/389; 44/393

(58) Field of Classification Search ..... 548/352.1; 514/563, 291; 524/543; 44/389, 393
See application file for complete search history.

(56) References Cited

U.S. PATENT DOCUMENTS

| | | | | |
|---|---|---|---|---|
| 2006/0199896 | A1* | 9/2006 | Walton et al. | 524/543 |
| 2006/0287352 | A1* | 12/2006 | Holm et al. | 514/291 |
| 2007/0027213 | A1* | 2/2007 | Oberegger et al. | 514/563 |
| 2010/0087656 | A1* | 4/2010 | Muller et al. | 548/352.1 |

FOREIGN PATENT DOCUMENTS

WO WO9704044 * 2/1997

OTHER PUBLICATIONS

Product Bulletin, Stepan Co., Drewpol 3-5-M, Jan. 2006, two pages, Northfield, IL.
Product Bulletin, Stepan Co., Drewpol PGPR, Feb. 2006, two pages, Northfield, IL.

* cited by examiner

*Primary Examiner* — Ellen McAvoy
*Assistant Examiner* — Chantel Graham
(74) *Attorney, Agent, or Firm* — Patzik, Frank & Samotny Ltd.

(57) ABSTRACT

A diesel fuel additive for use in association with bio-diesel fuel and/or petroleum derived diesel fuel having one or more solvent(s) and one or more pour-point depressant(s), wherein the pour-point depressant(s) include a polyglycerol ester, such as polyglycerol polyricinoleate and/or polyglycerol esters of mixed fatty acids. Augmentive agents may include ethylene vinyl acetate and/or polyethylene vinyl acetate.

6 Claims, No Drawings

DIESEL FUEL, DIESEL FUEL ADDITIVE, AND ASSOCIATED METHOD FOR USING THE SAME

CROSS-REFERENCE TO RELATED APPLICATION(S)

This application claims the benefit of U.S. Provisional Patent Application No. 60/940,986, filed May 31, 2007, the entirety of which is hereby incorporated by reference.

BACKGROUND OF THE INVENTION

1. Field of the Invention

The present invention relates in general to fuel additives and, more particularly, to diesel fuel additives which improve low temperature handling properties of diesel fuels—including bio-diesel fuels and/or petroleum derived diesel fuels.

2. Background Art

Vehicles having engines which consume diesel fuel have been known in the art for years, and are becoming increasingly popular in industrialized nations where, among other things, the cost of gasoline has become prohibitively expensive. As the popularity of vehicles with diesel engines has grown, so too has the demand for a plurality of different types of diesel fuels, including both bio-diesel fuels and petroleum derived diesel fuels. While the utilization of vehicles with diesel engines has become increasingly popular, issues relative low temperature handling properties remains largely problematic, especially with regard to bio-diesel fuels. In particular, pure bio-diesel (e.g. 100% methyl soyate) typically stops flowing freely at approximately 29 degrees Fahrenheit. Indeed, vehicles with diesel engines consuming bio-diesel fuels can be, during normal operation, exposed to extreme temperatures ranging from approximately less than 0 degrees Fahrenheit to approximately more than 100 degrees Fahrenheit.

Accordingly, it is an object of the present invention to provide diesel fuels, especially bio-diesel fuels, having additives which enable associated vehicles to freely start and/or operate during normal use—including exposure to extreme temperatures, such as, for example, during winter in the United States, Canada, Europe, etcetera.

These and other objects of the present invention will become apparent in light of the present specification, claims, and/or drawings.

SUMMARY OF THE INVENTION

In one embodiment, the present invention is directed to a diesel fuel additive comprising at least one solvent, and at least one pour-point depressant, wherein the at least one pour-point depressant comprises a polyglycerol ester.

Preferably the majority species of the above-identified polyglycerol esters comprise polyglycerol polyol chains that have been esterified with alkyl-carboxyl moieties or fatty acids. It will be understood that the above-identified polyglycerols may comprise several species with various structures such as, but not limited to linear, branched, and/or cyclic polyglycerol polyols, which may be non-esterified, partially esterified, and/or completely esterified and be ester and/or hydroxyl terminated.

In a preferred embodiment of the present invention, the at least one pour-point depressant is represented by the following chemical structure:

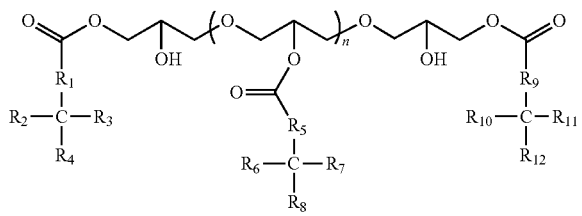

wherein n is an integer ranging from approximately 1 to approximately 100, more preferably from approximately 1 to approximately 25, and most preferably from approximately 1 to approximately 5; wherein $R_1$-$R_{12}$ are the same or different and comprise: (1) H; (2) a straight and/or branched alkyl, cycloalkyl, polycycloalkyl, heterocycloalkyl, aryl, alkaryl, aralkyl, alkoxy, alkenyl, and/or alkynyl group containing approximately 1 to approximately 100 carbon atom(s), more preferably approximately 1 to approximately 25 carbon atom(s); (3) a silyl and/or siloxyl group containing approximately 1 to approximately 100 silicon atom(s), more preferably approximately 1 to approximately 25 silicon atom(s); and/or (4) mixtures thereof; and wherein the carbon or silicon atom(s) may be a linking group to, or part of, one or more functional groups selected from the group consisting of alcohols, thiols, thioethers, nitriles, nitro constituents, sulfoxides, sulfonates, phosphonium constituents, phosphonates, phosphonites, ammonium constituents, carbonyls, carbonates, carbamates, ketones, esters, amides, ethers, amines, and mixtures thereof.

In another preferred embodiment of the present invention, the at least one pour-point depressant is represented by the following chemical structure:

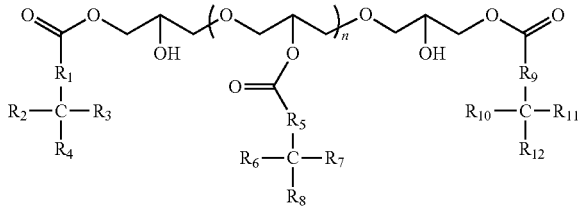

wherein n is an integer ranging from approximately 1 to approximately 100, more preferably from approximately 1 to approximately 25, and most preferably from approximately 1 to approximately 5; and wherein $R_1$-$R_{12}$ are the same or different and are selected from the group comprising: (1) H; (2) a straight and/or branched alkyl, cycloalkyl, polycycloalkyl, heterocycloalkyl, aryl, alkaryl, aralkyl, alkoxy, alkenyl, and/or alkynyl group containing approximately 1 to approximately 100 carbon atom(s), more preferably approximately 1 to approximately 25 carbon atom(s); and/or (3) mixtures thereof.

In yet another preferred embodiment of the present invention, the at least one pour-point depressant comprises polyglycerol esters of mixed fatty acids.

In a preferred embodiment of the present invention, the at least one pour-point depressant is represented by the following chemical structure:

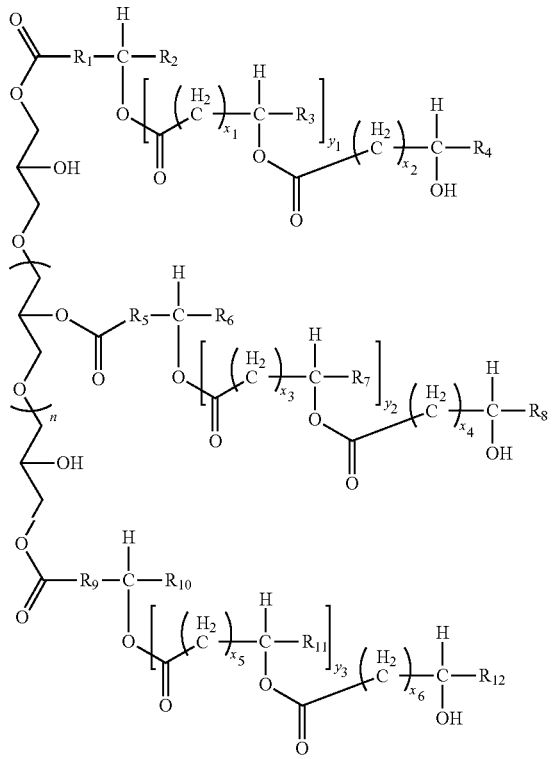

wherein n is an integer ranging from approximately 1 to approximately 100, more preferably from approximately 1 to approximately 15, and most preferably from approximately 1 to approximately 5; wherein $x_1$-$x_6$ are the same or different and comprise an integer ranging from approximately 1 to approximately 100, more preferably from approximately 1 to approximately 20, and most preferably from approximately 1 to approximately 15; wherein $y_1$-$y_3$ are the same or different and comprise an integer ranging from approximately 1 to approximately 50, more preferably from approximately 1 to approximately 10, and most preferably from approximately 1 to approximately 5; wherein $R_1$-$R_{12}$ are the same or different and are selected from the group comprising: (1) H; (2) a straight and/or branched alkyl, cycloalkyl, polycycloalkyl, heterocycloalkyl, aryl, alkaryl, aralkyl, alkoxy, alkenyl, and/or alkynyl group containing approximately 1 to approximately 100 carbon atom(s), more preferably approximately 1 to approximately 25 carbon atom(s); (3) a silyl and/or siloxyl group containing approximately 1 to approximately 100 silicon atom(s), more preferably approximately 1 to approximately 25 silicon atom(s); and/or (4) mixtures thereof; and wherein the carbon or silicon atom(s) may be a linking group to, or part of, one or more functional groups selected from the group consisting of alcohols, thiols, thioethers, nitriles, nitro constituents, sulfoxides, sulfonates, phosphonium constituents, phosphonates, phosphonites, ammonium constituents, carbonyls, carbonates, carbamates, ketones, esters, amides, ethers, amines, and mixtures thereof.

In yet another preferred embodiment of the present invention, the at least one pour-point depressant is represented by the following chemical structure:

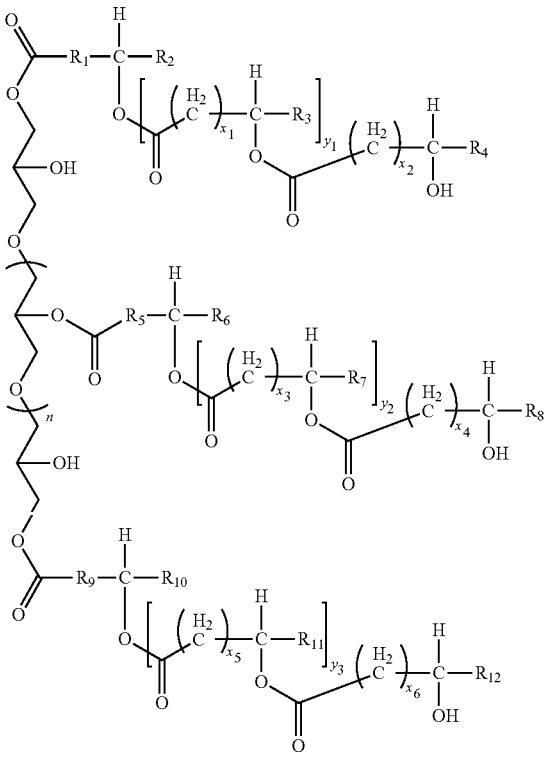

wherein n is an integer ranging from approximately 1 to approximately 100, more preferably from approximately 1 to approximately 15, and most preferably from approximately 1 to approximately 5; wherein $x_1$-$x_6$ are the same or different and comprise an integer ranging from approximately 1 to approximately 100, more preferably from approximately 1 to approximately 20, and most preferably from approximately 1 to approximately 15; wherein $y_1$-$y_3$ are the same or different and comprise an integer ranging from approximately 1 to approximately 50, more preferably from approximately 1 to approximately 10, and most preferably from approximately 1 to approximately 5; and wherein $R_1$-$R_{12}$ are the same or different and comprise: (1) H; (2) a straight and/or branched alkyl, cycloalkyl, polycycloalkyl, heterocycloalkyl, aryl, alkaryl, aralkyl, alkoxy, alkenyl, and/or alkynyl group containing approximately 1 to approximately 100 carbon atom(s), more preferably approximately 1 to approximately 25 carbon atom(s); and/or (3) mixtures thereof.

In yet another preferred embodiment of the present invention, the at least one pour-point depressant comprises polyglycerol polyricinoleate.

In another embodiment, the present invention is directed to a diesel fuel additive comprising at least one solvent, a first pour-point depressant, and a second pour-point depressant, wherein at least one of the first and second pour-point depressants comprises a polyglycerol ester. In this embodiment the first pour-point depressant preferably comprises polyglycerol polyricinoleate, and the second pour-point depressant preferably comprises polyglycerol esters of mixed fatty acids.

In another aspect of the present invention, the at least one solvent comprises hydrocarbons, aromatic hydrocarbons, alcohols, ethers, nitriles, mineral spirits, bio-diesel fuel, petroleum derived diesel fuel, and/or mixtures thereof.

In yet another aspect of the present invention, a bio-diesel fuel and/or petroleum derived diesel fuel is associated with a diesel fuel additive as disclosed supra.

In one embodiment, the present invention is directed to a method for using a diesel fuel additive comprising the steps of: providing a solvent; providing a diesel fuel additive comprising at least one pour-point depressant, wherein the at least one pour-point depressant comprises polyglycerol polyricinoleate and/or polyglycerol esters of mixed fatty acids; and associating the diesel fuel additive with the solvent.

In another aspect of the present invention, ethylene vinyl acetate (EVA) and/or polyethylene vinyl acetate (PEVA) may be utilized as a pour-point depressant, for example, in cooperation with one or more pour-point depressant(s), such as a polyglycerol ester as disclosed herein.

DETAILED DESCRIPTION OF THE INVENTION

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

In accordance with the present invention a diesel fuel additive is provided which comprises one or more solvent(s), and one or more pour-point depressant(s), such as polyglycerol esters, ethylene vinyl acetate and/or polyethylene vinyl acetate. As is shown experimentally herein below, one or more pour-point depressant(s) substantially improves the low temperature handling properties of diesel fuels—especially bio-diesel fuels.

Preferably the majority species of the above-identified polyglycerol esters comprise polyglycerol polyol chains that have been esterified with alkyl-carboxyl moieties or fatty acids. It will be understood that the above-identified polyglycerols may comprise several species with various structures such as, but not limited to linear, branched, and/or cyclic polyglycerol polyols, which may be non-esterified, partially esterified, and/or completely esterified and be ester and/or hydroxyl terminated.

In one embodiment of the present invention, the polyglycerol ester pour-point depressant is represented by the following chemical structure:

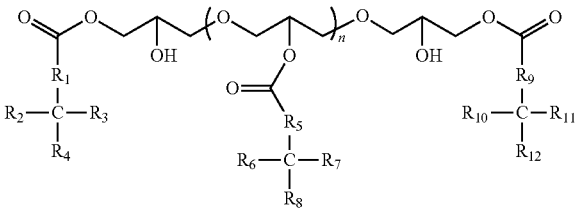

wherein n is an integer ranging from approximately 1 to approximately 100, more preferably from approximately 1 to approximately 25, and most preferably from approximately 1 to approximately 5; wherein $R_1$-$R_{12}$ are the same or different and comprise: (1) H; (2) a straight and/or branched alkyl, cycloalkyl, polycycloalkyl, heterocycloalkyl, aryl, alkaryl, aralkyl, alkoxy, alkenyl, and/or alkynyl group containing approximately 1 to approximately 100 carbon atom(s), more preferably approximately 1 to approximately 25 carbon atom(s); (3) a silyl and/or siloxyl group containing approximately 1 to approximately 100 silicon atom(s), more preferably approximately 1 to approximately 25 silicon atom(s); and/or (4) mixtures thereof; and wherein the carbon or silicon atom(s) may be a linking group to, or part of, one or more functional groups selected from the group consisting of alcohols, thiols, thioethers, nitriles, nitro constituents, sulfoxides, sulfonates, phosphonium constituents, phosphonates, phosphonites, ammonium constituents, carbonyls, carbonates, carbamates, ketones, esters, amides, ethers, amines, and mixtures thereof.

In this embodiment, the pour-point depressant is preferably represented by the following chemical structure:

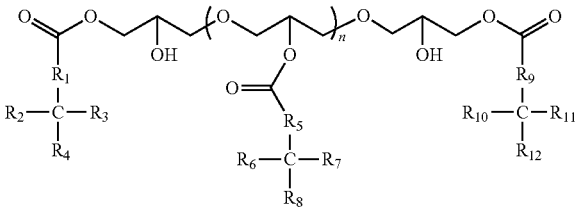

wherein n is an integer ranging from approximately 1 to approximately 100, more preferably from approximately 1 to approximately 25, and most preferably from approximately 1 to approximately 5; and wherein $R_1$-$R_{12}$ are the same or different and are selected from the group comprising: (1) H; (2) a straight and/or branched alkyl, cycloalkyl, polycycloalkyl, heterocycloalkyl, aryl, alkaryl, aralkyl, alkoxy, alkenyl, and/or alkynyl group containing approximately 1 to approximately 100 carbon atom(s), more preferably approximately 1 to approximately 25 carbon atom(s); and/or (3) mixtures thereof. For example, the pour-point depressant disclosed supra may include polyglycerol esters of mixed fatty acids, such as Drewpol 3-5-M, which is commercially available from Stepan Company of Northfield, Ill. It will be understood that while one, preferred polyglycerol ester has been disclosed for illustrative purposes only, any one of a number of other polyglycerol esters that would be known to those having ordinary skill in the art having the present disclosure before them are likewise contemplated for use in accordance with the present invention.

In another embodiment of the present invention, the polyglycerol ester pour-point depressant is represented by the following chemical structure:

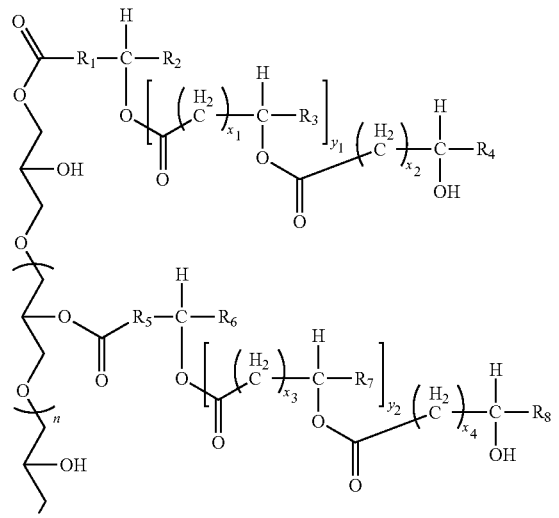

-continued

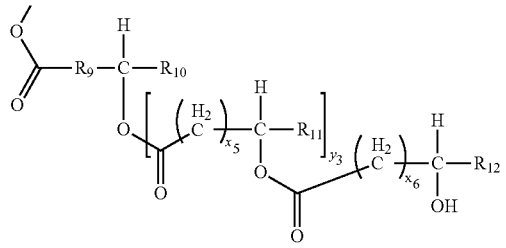

wherein n is an integer ranging from approximately 1 to approximately 100, more preferably from approximately 1 to approximately 15, and most preferably from approximately 1 to approximately 5; wherein $x_1$-$x_6$ are the same or different and comprise an integer ranging from approximately 1 to approximately 100, more preferably from approximately 1 to approximately 20, and most preferably from approximately 1 to approximately 15; wherein $y_1$-$y_3$ are the same or different and comprise an integer ranging from approximately 1 to approximately 50, more preferably from approximately 1 to approximately 10, and most preferably from approximately 1 to approximately 5; wherein $R_1$-$R_{12}$ are the same or different and are selected from the group comprising: (1) H; (2) a straight and/or branched alkyl, cycloalkyl, polycycloalkyl, heterocycloalkyl, aryl, alkaryl, aralkyl, alkoxy, alkenyl, and/or alkynyl group containing approximately 1 to approximately 100 carbon atom(s), more preferably approximately 1 to approximately 25 carbon atom(s); (3) a silyl and/or siloxyl group containing approximately 1 to approximately 100 silicon atom(s), more preferably approximately 1 to approximately 25 silicon atom(s); and/or (4) mixtures thereof; and wherein the carbon or silicon atom(s) may be a linking group to, or part of, one or more functional groups selected from the group consisting of alcohols, thiols, thioethers, nitriles, nitro constituents, sulfoxides, sulfonates, phosphonium constituents, phosphonates, phosphonites, ammonium constituents, carbonyls, carbonates, carbamates, ketones, esters, amides, ethers, amines, and mixtures thereof.

In this embodiment, the pour-point depressant is preferably represented by the following chemical structure:

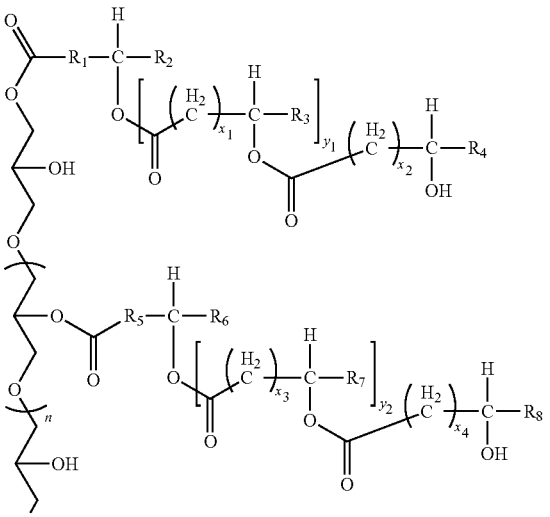

-continued

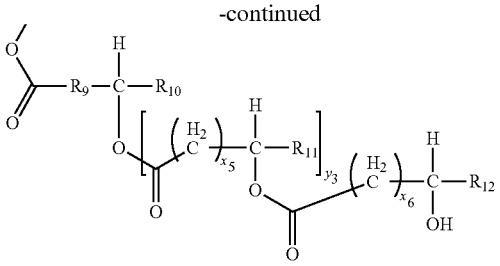

wherein n is an integer ranging from approximately 1 to approximately 100, more preferably from approximately 1 to approximately 15, and most preferably from approximately 1 to approximately 5; wherein $x_1$-$x_6$ are the same or different and comprise an integer ranging from approximately 1 to approximately 100, more preferably from approximately 1 to approximately 20, and most preferably from approximately 1 to approximately 15; wherein $y_1$-$y_3$ are the same or different and comprise an integer ranging from approximately 1 to approximately 50, more preferably from approximately 1 to approximately 10, and most preferably from approximately 1 to approximately 5; and wherein $R_1$-$R_{12}$ are the same or different and comprise: (1) H; (2) a straight and/or branched alkyl, cycloalkyl, polycycloalkyl, heterocycloalkyl, aryl, alkaryl, aralkyl, alkoxy, alkenyl, and/or alkynyl group containing approximately 1 to approximately 100 carbon atom(s), more preferably approximately 1 to approximately 25 carbon atom(s); and/or (3) mixtures thereof For example, the pour-point depressant disclosed supra may include polyglycerol polyricinoleate, such as Drewpol PGPR, which is commercially available from Stepan Company of Northfield, Ill. Once again, it will be understood that while a, preferred polyglycerol ester has been disclosed for illustrative purposes only, any one of a number of other polyglycerol esters that would be known to those having ordinary skill in the art having the present disclosure before them are likewise contemplated for use in accordance with the present invention.

As is shown experimentally herein below, ethylene vinyl acetate (EVA) and/or polyethylene vinyl acetate (PEVA) may be utilized as a pour-point depressant (i.e. augmentive agent), for example, in cooperation with one or more pour-point depressant(s), such as a polyglycerol ester as disclosed herein. Surprisingly, utilization of the augmentive agent in cooperation with one or more pour-point depressant(s) appears to synergistically lower the pour-point of an associated fuel—even at low concentrations. It will be understood that EVA and PEVA are commercially available from any one of a number of common vendors including, among others, MidContinental Chemical Company and/or Aldrich Chemicals.

Preferred solvents for use in accordance with the present invention include, for example, hydrocarbons (e.g. 2-ethylhexyl isononanoate), aromatic hydrocarbons (e.g. benzene, toluene, xylene(s)), alcohols (e.g. isopropanol), ethers, nitriles, mineral spirits, bio-diesel fuel, petroleum derived diesel fuel, and/or mixtures thereof. While the above-identified solvents have been disclosed for use in accordance with the present invention, any one of a number of other solvents are likewise contemplated for use.

In another aspect of the present invention a diesel fuel additive is disclosed which comprises one or more solvent(s), a first pour-point depressant, and a second pour-point depressant, wherein the first and/or second pour-point depressant comprises a polyglycerol ester. In this embodiment the first pour-point depressant preferably comprises polyglycerol polyricinoleate, and the second pour-point depressant preferably comprises a polyglycerol ester of mixed fatty acids.

It will be understood that the fuel additives disclosed herein can be associated with bio-diesel fuel and/or petroleum derived diesel fuel. Regardless of its ordinary meaning, the term bio-diesel herein refers to a diesel-equivalent, processed fuel derived from biological sources (e.g. vegetable oils), which can be used in unmodified and/or modified diesel engine vehicles.

The present invention is further directed to a method for using a diesel fuel additive comprising the steps of: (1) providing a solvent; (2) providing a diesel fuel additive comprising at least one pour-point depressant, wherein the at least one pour-point depressant comprises polyglycerol polyricinoleate and/or polyglycerol esters of mixed fatty acids; and (3) associating the diesel fuel additive with the solvent. Once the diesel fuel additive has been associated with the solvent, the same can be consumed by a vehicle having a diesel engine. One benefit, among others, of using such a diesel fuel additive is that the diesel fuel can be poured and/or consumed at substantially lower temperatures than without the additive.

In support of the present invention, several experiments were conducted to determine the pour-point of different diesel fuels having one or more additives relative to the same without such additives.

Experiment No. 1

In this experiment a bio-diesel fuel additive was prepared by combining the following chemicals:

| Chemical | Concentration (Weight %) |
|---|---|
| Xylene - solvent (Aldrich) | 30 |
| Isopropanol - solvent (Aldrich) | 20 |
| Coldflow 105 - pour-point depressant (MidContinental Chemical Company) | 20 |
| Drewpol PGPR (Stepan) - pour-point depressant | 10 |
| Drewpol 3-5-M (Stepan) - pour-point depressant | 20 |

After preparing the additive, the pour-point of several diesel fuels having the above-identified additive was compared to the pour-point of the same fuels without the additive. The results are tabulated herein below:

| Diesel Fuel | Pour-Point (F.) |
|---|---|
| Iowa B-20 (no additive) | −3 |
| Iowa B-20 (0.1% additive, 1 pint/saddle tank) | −18 |
| Illinois B-11 (no additive) | −3 |
| Illinois B-11 (0.2% additive, 1 quart/saddle tank) | −29 |
| B-100 (no additive) | 29 |
| B-100 (0.5% additive, 2 quarts/saddle tank) | <−34 |

Experiment No. 2

In this experiment a plurality of bio-diesel fuel additive formulations were prepared. After preparing the formulations, the pour-point of each formulation was measured and is provided herein below:

| Diesel Fuel/ Additive Formulation | Concentration (Weight %) | Pour-Point (F.) |
|---|---|---|
| B-100 (no additive) | 100 | 28 |
| B-100* | 99.78 | 19 |
| 60% EVA | 0.22 | |
| B-100* | 99.57 | 17 |
| 60% EVA | 0.43 | |
| B-100* | 99.37 | 18 |
| 60% EVA | 0.43 | |
| Drewpol PGPR | 0.19 | |
| B-100* | 99.67 | 1 |
| 60% EVA | 0.22 | |
| Drewpol 3-5-M | 0.11 | |
| B-100* | 99.53 | <−22 |
| 60% EVA | 0.22 | |
| Drewpol 3-5-M | 0.11 | |
| Drewpol PGPR | 0.14 | |
| B-100* | 98.88 | 19 |
| Drewpol 3-5-M | 1.12 | |
| B-100* | 98.03 | 13 |
| Drewpol 3-5-M | 1.12 | |
| Drewpol PGPR | 0.85 | |
| B-100* | 99.58 | 29 |
| Drewpol PGPR | 0.42 | |
| B-100* | 98.95 | 16 |
| Drewpol 3-5-M | 0.42 | |
| Drewpol PGPR | 0.63 | |

*It will be understood that in the formulations provided in Experiment No. 2, nominal amounts of non-native solvents have been uniformly omitted from the formulation description for comparative purposes.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A diesel fuel additive, comprising:

at least one of ethylene vinyl acetate and polyethylene vinyl acetate;

at least one polyglycerol ester of mixed fatty acids; and at least one polyglycerol polyricinoleate.

2. The diesel fuel additive according to claim 1, wherein the at least one of ethylene vinyl acetate and polyethylene vinyl acetate is present in an amount of about 0.13% wt when the diesel fuel additive is added to diesel fuel present in an amount of about 99.53% wt.

3. The diesel fuel additive according to claim 1, wherein the at least one polyglycerol ester of mixed fatty acids is present in an amount of about 0.11% wt when the diesel fuel additive is added to diesel fuel present in an amount of about 99.53% wt.

4. The diesel fuel additive according to claim 1, wherein the at least one polyglycerol polyricinoleate is present in an amount of about 0.14% wt when the diesel fuel additive is added to diesel fuel present in an amount of about 99.53% wt.

5. The diesel fuel additive according to claim 1, wherein:

the at least one of ethylene vinyl acetate and polyethylene vinyl acetate is present in an amount of about 0.13% wt;

the at least one polyglycerol ester of mixed fatty acids is present in an amount of about 0.11% wt; and the least one polyglycerol polyricinoleate is present in an amount of about 0.14% wt;

when added to diesel fuel present in an amount of about 99.53% wt.

6. The diesel fuel additive according to claim 1, wherein the at least one of ethylene vinyl acetate and polyethylene vinyl acetate comprises ethylene vinyl acetate.

* * * * *